United States Patent [19]

Hallqvist et al.

[11] 4,376,407

[45] Mar. 15, 1983

[54] DEVICE FOR BREECH RING

[75] Inventors: Sten Hallqvist; Erik Eriksson, both of Karlskoga, Sweden

[73] Assignee: Aktiebolaget Bofors, Bofors, Sweden

[21] Appl. No.: 217,596

[22] Filed: Dec. 18, 1980

[30] Foreign Application Priority Data

Dec. 18, 1979 [SE] Sweden ..... 7910443

[51] Int. Cl.[3] ..... F41F 11/07

[52] U.S. Cl. ..... 89/20 R

[58] Field of Search ..... 89/20 R, 21, 25, 47

[56] References Cited

U.S. PATENT DOCUMENTS 811,797 2/1906 Schneider ..... 89/47

FOREIGN PATENT DOCUMENTS 931240 2/1948 France ..... 89/47

*Primary Examiner*—Stephen C. Bentley

*Attorney, Agent, or Firm*—Pollock, Vande Sande & Priddy

[57] ABSTRACT

A breech ring (1) in a firearm, which can be closed and opened with a screw mechanism which comprises a screw (4). The breech ring has conical threads (5) which can coact with corresponding threads on the screw. The threads of both the breech ring and the screw have sectors without threads, arranged so that the screw can be inserted into its final longitudinal displacement position and thereafter turned into coaction with the threads of the breech ring for securing of the screw in the breech ring. In the sectors without threads there are arranged counter-holding plate springs (11*a*, 11*b*, and 11*c*) which in coaction with a stripper achieve a counter-holding and centering function for a bag charge (18) or the like, which has been inserted into the firearm by a ramming unit behind a shell or the like, the position of which in the longitudinal direction is thereafter adjusted during the extraction of the ramming unit from the chamber of the firearm. The respective counter-holding springs then have the form of a plate spring fastened in one end which assumes a position unactuated by the screw with the aid of its own spring action, and a position actuated by the screw when it is pressed down into the sector without threads.

9 Claims, 2 Drawing Figures

DEVICE FOR BREECH RING

TECHNICAL FIELD

The present invention relates to a device for a breech ring in a firearm, which can be closed and opened by means of a screw mechanism of the firearm and which screw has screw threads with sectors without threads.

BACKGROUND ART

For firearms of the kind in question it is previously known to use a so-called stripper which serves the purpose of acting with an ammunition unit, such as a charge or a bag charge, when a ramming unit (rammer head) has inserted the ammunition into the chamber of the firearm and the ramming unit is thereafter extracted from the chamber. The stripper has, owing to other mechanisms in the loading system of the firearm, been bound to a position corresponding to approx. 2 o'clock on a clock dial, seen from a rear view of the breech ring.

The stripper is moreover placed in a position where its section which acts with the ammunition unit will be somewhat behind the rear surface of the barrel.

SUMMARY OF INVENTION

Due to the stripper having the position indicated above and which cannot extend far into the cross section of the bore of the barrel and the chamber located behind the same which exceeds the radius of said chamber, and because the bag charge or the like in certain cases has a diameter which permits it to be pulled out of the chamber when the ramming unit is extracted, that the loading process has not functioned satisfactorily in all cases.

The main purpose of the present invention is to solve the above-mentioned problems in a technically simple and, accordingly, economic way. In accordance with the invention there is arranged at two or more of the sectors without threads a counter-holding means which has the form of a plate spring with its first end fastened in the breech ring. The respective plate spring is arranged so that in a position where it is not actuated by the screw it will have its second end sprung up through its own spring action a distance above the sector without threads and the screw threads to permit coaction between the second end and an ammunition unit placed in the firearm. In a position where it is actuated by the screw it will be pressed down into the sector without threads to permit closing of the screw.

In further developments of the invention further details are proposed with counter-holding springs in relation to a stripper which is utilized. Further, designs are indicated for the respective plate springs.

However, the features that can mainly be considered to be characteristic for a device according to the present invention will be noted from the characterizing part of the following claim 1.

Through the invention a technically simple but nevertheless efficient counter-holding function is obtained which, in principle, extends the chamber rearwards, and for all cases occurring in practice gives a suitable loading function for a loading system for separate-loading ammunition.

The plate springs used as counter-holding means do not obstruct the functioning of other parts comprised in the loading system and thus the screw mechanism, for instance, can work entirely unaffected by the counter-holding means.

BRIEF DESCRIPTION OF DRAWINGS

An embodiment proposed at present of a device which has the characteristics significant for the invention will be described in more detail in the following, with reference to the accompanying drawings, in which FIG. 1 in a vertical section shows the positioning of a counter-holding means at the parts concerned of the breech ring and barrel of a firearm which utilizes the present invention, and FIG. 2 from the rear shows the arrangement of the counter-holding means in a breech ring in accordance with FIG. 1.

BEST MODE OF CARRYING OUT THE INVENTION

Figure 1:
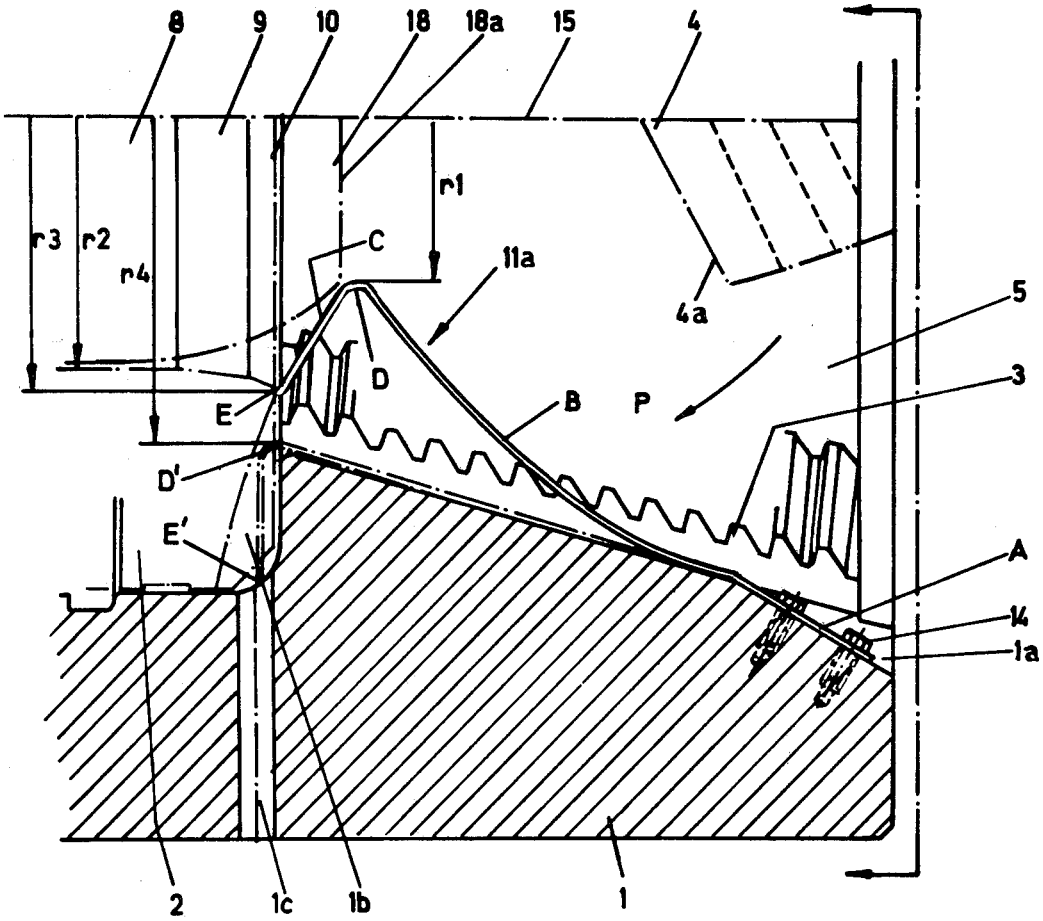

In FIG. 1, a breech ring of a firearm is indicated by the numeral 1, and the barrel part has been given the designation 2. In the breech ring, in a way which is known in itself, there are arranged conical screw threads 3 for an also previously well-known screw mechanism. At its upper parts, the mechanism has a screw 4 which can be turned up and down, and which has threads corresponding to threads 3. Both the threads of the breech ring and those of the screw have sectors without threads, which make it possible to swing the screw in the direction of the arrow P to an end position in the longitudinal direction and to turn it in the end position approx. 30° so that the threads of the screw will engage the threads of the breech ring and efficient securing of the screw in the breech ring is obtained.

Figure 2:
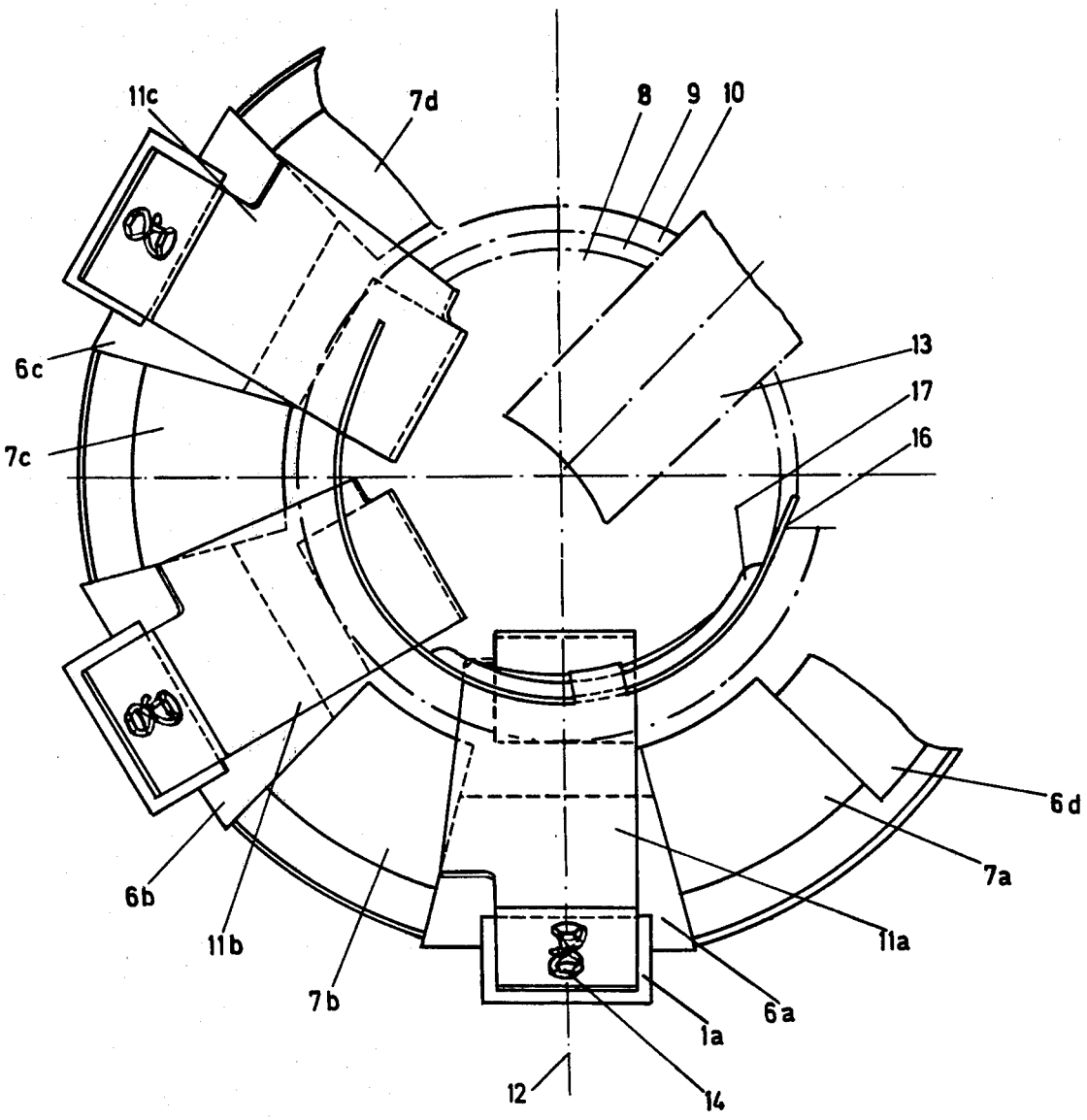

In the present case, there are six sectors without threads around the periphery of the screw and the recess 5 in the breech ring, respectively. In FIG. 2, four sectors without threads in the breech ring have been shown by 6, **6*b*, 6*c*, and 6*d*, and four sectors with threads by 7*a*, 7*b*, 7*c*, and 7*d***.

The figure also shows the threaded bore of the barrel, indicated by 8, and the widening of the bore of the barrel towards the chamber in the breech ring is indicated by 9 and 10.

In the respective sectors 6, **6*b*, and 6*c* without threads, there are arranged counter-holding springs 11*a*, 11*b*, and 11*c*, the counter-holding spring 11*a* then being arranged in the sector 6*a*, without threads, which is located farthest down and symmetrical to the vertical line 12 in the section according to FIG. 2. The counter-holding spring 11*b* is located in the sector 6*b* without threads nearest to the left of sector 6*a*, and the counter-holding spring 11*c* is located in the sector 6*c*, without threads, nearest the sector 6*b***.

In a sector without threads, not shown, which is located in the position of approx. 2 o'clock on a clock dial, there is arranged a stripper 13, partly shown, which can be of a kind which is known. Through the arrangement shown with the counter-holding springs, the intermediate spring **11*b* will be substantially diametrically opposite the stripper 13. The respective counter-holding spring comprises a plate spring with a substantially straight fastening part A at its first end. The plate spring is fastened by means of two screws 14 via a recess 1*a*** made in the sector without threads, arranged so that the heads of the screws will be located below the level of the bottom of the sector without threads. The plate spring also comprises an intermediate part B in connection with the fastening part, which in the unactuated position of the spring is curved upwards towards its second end where the plate spring has an angular part C. In the unactuated position of the spring the part B and the part C form an approx. 90° angle in relation to each other. Viewed in its horizontal plane, the intermediate part B is wider than the fastening part and the angular part, and all of the parts have a common straight longitudinal side, viewed in the horizontal section. The respective plate spring part is substantially of uniform width, the part B then having a width which is somewhat less than the narrowest section of the sector without threads. The various parts of the plate spring have a thickness of 1–2 mm, and are made of conventional spring steel, and will be inclined obliquely forwards/inwards, viewed from the supporting point.

The parts of the spring are moreover arranged in such a way that in the unactuated condition of the spring a knee formed between the parts B and C at the second end of the spring will be at a distance r1 from the axis 15 of the bore of the barrel which is much shorter than the radius r2 of the bore of the barrel. Further, the angular part C has an extent where its free end E will be at a distance r3 which well exceeds the radius r2 of the bore of the barrel. In the practical case, the relationships are thus $r1 \approx \frac{2}{3}\ r2$ and $r2 \approx 4/5\ r3$.

The plate spring can assume a position unactuated by the screw 4 which is shown by solid lines in FIG. 1. In this position, the knee D is at the distance r1 from the axis 15 of the bore. Further, the plate spring can assume a position actuated by the screw in which the screw keeps the spring pressed down against the bottom of the sector without threads, which last-mentioned position is indicated by dot-dash lines. In this case, the angular part is pressed down into a space 1*b* under the bore of the barrel to which a drain hole 1*c* is connected. In this case, the knee has the position D′, and the free end of the angular part has the position E′. The knee will be at a distance r4 from the axis 15 of the bore, which last-mentioned distance exceeds the radius r2.

The present arrangement with counter-holding springs is intended for use in connection, with a loading system which is known in itself comprising a loading tray 16 arranged behind the breech ring, and also a ramming unit 17 by means of which a shell or the like can be rammed into the bore of the barrel and with which a charge, bag charge or other type of charge 18 which is not part of a complete round can be inserted to a position behind the rammed shell. The loading tray is then arranged so that it can be swung in from the side from a feeding position for the shell to a position where the shell is in the extension of the axis of the bore. Also the ramming unit can be swung in from a side position, where the ramming unit is arranged to receive the bag charge, to a swung-in position where the bag charge is in line with and behind the shell on the loading tray. Further, the ramming unit can be displaced longitudinally in the longitudinal direction of the firearm, and at its front end the ramming unit has a tooth which can be turned up and down, via which the ramming unit actuates the shell for insertion into the bore of the barrel. The ramming unit is displaceable in relation to the loading tray and coaxially therewith. At its forward movement the ramming unit follows the shell into the chamber. However, the final part of the ramming of the shell takes place by means of free flight of the shell. When the ramming unit in this way has achieved the ramming of the shell in the origin of the rifling of the bore of the barrel the ramming unit is given a movement backwards, during which the ramming unit is extracted from the chamber in the barrel. The tooth is turned down during the beginning of the extraction process.

In case the distance between the rear surface of the rammed shell and an inner surface 4*a* of the screw, when this is secured in the breech ring, exceeds the length of the bag charge (in the case of one bag charge) or the bag charges (in the case of several bag charges placed one after the other) the ramming unit shall achieve a retraction of the bag charge or bag charges so that the rear end surface 18*a* of the bag charge or of the rear bag charge, will be located at the inner surface 4*a*. In order to obtain a distinct stripping function for the bag charge from the ramming unit and an exact retraction position, the end surface 18*a* goes into coaction with the stripper 13 and the counter-holding spring 11*a*, 11*b*, and 11*c*. The coaction between the counter-holding springs and the bag charge then takes place via the front surface of the angular parts C of the counter-holding springs. In addition to achieving an efficient stopping function for the bag charges, regardless of their diameter in relation to the diameter of the bore of the barrel, there will be a certain centering of the bag charge in relation to the bore of the barrel. The end surface 18*a* of the bag charge will obtain a longitudinal displacement position in which, for instance, there is no risk that the bag charge will be thrown forwards at the closing of the screw through coaction between the surface 4*a* of the screw and the end surface 18*a* of the bag charge.

The invention is not limited to the embodiment shown above as an example, but can be subject to modifications within the scope of the following claims.

INDUSTRIAL APPLICABILITY

The components which the invention concerns are easy to manufacture and integrate with a firearm at a factory, in an efficient manufacture, or out in the field.

We claim:

1. In a firearm having a threaded breech ring closed by a threaded screw mechanism, said firearm receiving a shell component and a charge from a ramming operation, said charge being retained in place by a stripper extending through a slot in said screw mechanism during a ram removing operation, an apparatus for improving the stripper action comprising:

a plurality of plate springs, each connected at one end in a recess of said breech ring and extending into said breech ring through a plurality of sectors on said breech ring and screw mechanism which are without threads, said plate springs extending towards the bore axis of said firearm along a first portion, then away from said bore axis at an angle to said first portion along a second portion when said screw mechanism is not engaged in said breech ring; and said plate springs second portion retaining with said stripper said charge at a predetermined location during said ram removing operation, and said plate springs being pressed against said breech ring along its first portion upon closure of said breech mechanism and said second portion extends into a space of said breech ring.

2. A device according to claim 1 wherein said first portion is curved.

3. A device according to claim 1 or 2 wherein each of said plate springs is arranged so that it can be moved down against said breech ring by a first ammunition unit in the form of a shell which by a ramming unit is inserted in the bore of the barrel, and by the ramming unit and said charge in the form of a bag charge, and the respective plate spring can spring away from said breech ring with the extraction of the ramming unit to abut the rear section of the second ammunition unit.

4. A device according to claim 3, wherein the coaction between the respective plate spring and the charge takes place along a knee formed on the plate spring where said first portion and second portion meet.

5. A device according to claim 4 wherein said first and second portions of said plate springs meet at a right angle.

6. A device according to claim 5, wherein the knee is located adjacent the rear end of the bore of the barrel in the breech ring.

7. A device according to claim 6, wherein in the unactuated position of a respective spring the free end of the knee is located at a first distance which exceeds the radius of the bore of the barrel, rearwards in the breech ring and said knee is located at a second distance which is less than the radius of the bore of the barrel.

8. A device according to claim 1, wherein three plate springs are arranged in three sectors without threads adjacent to each other, and that the middle plate spring is substantially diametrically opposite the stripper.

9. A device according to claim 1, wherein the respective plate spring is screwed to the breech ring with the securing means, in the form of two fastening screws.

* * * * *